United States Patent [19]

Bowman

[11] Patent Number: 4,703,569

[45] Date of Patent: Nov. 3, 1987

[54] POSTER MOUNTING SYSTEM

[76] Inventor: David Bowman, 2409 Menokin Dr., Apt. 204, Alexandria, Va. 22302

[21] Appl. No.: 878,214

[22] Filed: Jun. 25, 1986

[51] Int. Cl.[4] ..... G09F 3/18

[52] U.S. Cl. ..... 40/10 R; 40/13; 40/156

[58] Field of Search ..... 40/156, 152.1, 13, 14, 40/10

[56] References Cited

U.S. PATENT DOCUMENTS

| | | | |
|---|---|---|---|
| 25,750 | 10/1859 | McDougall | 40/10 R |
| 340,596 | 4/1886 | Mowat . | |
| 505,771 | 1/1893 | Kohr . | |
| 513,402 | 9/1894 | Lloyd . | |
| 1,632,856 | 6/1927 | Running | 40/10 R |
| 1,752,297 | 4/1930 | Gillette . | |
| 1,851,770 | 3/1932 | Johnson | 40/10 R |
| 2,120,404 | 6/1938 | Graff | 40/13 |
| 3,345,709 | 10/1967 | Bearman . | |
| 3,408,032 | 10/1968 | Francis . | |
| 3,575,373 | 4/1971 | Reinhardt . | |
| 3,965,599 | 6/1976 | Ebner . | |
| 4,211,382 | 7/1980 | Bonfils . | |

*Primary Examiner*—Henry E. Raduazo

*Attorney, Agent, or Firm*—Browdy and Neimark

[57] ABSTRACT

An adjustable non-destructive exhibit mounting system includes a lever, a fulcrum for supporting the lever, and a device for adjustably urging an end of the lever against an exhibit, thereby securing the exhibit against a planar display surface. The end of the lever which contacts the exhibit is provided with a sleeve-like protecting pad. The mounting system can accommodate the mounting of various sized planar exhibits. The adjusting device includes a base which can rest against the display surface, a threaded bolt extending from the base and at least one nut threadably engaging the bolt. The nut may be set to urge the lever into a position tensioning the protecting pad against the exhibit.

19 Claims, 7 Drawing Figures

POSTER MOUNTING SYSTEM

FIELD OF THE INVENTION

The present invention relates to poster mounting systems and, more particularly, poster mounting systems which prevent the destruction of posters when secured on or removed from display surfaces, and which will further facilitate the mounting of various size posters.

BACKGROUND OF THE INVENTION

Conventional poster mounting systems usually require securing means which will injure or destroy a poster when mounted on or removed from a display surface. The common use of adhesives, such as tapes and glues, present the problem of tearing the poster's backside, frequently destroying the frontside (exhibit side) when removed from a wall or other like planar display surface. Over the years, attempts have been made to overcome the usage of adhesives as poster or picture mounting means. For example, U.S. Pat. No. 1,301,885 to Tobiason et al., shows a picture mounting system including an elongated U-shaped clamping member equipped with a suction cup device for securing the clamp to a wall or window. The picture is adapted to be received within the U-shaped clamp and retained therein by means of encompassing clamp rings which squeeze the clamping member tightly around-/against the picture. While this mounting system may accommodate different sized pictures, the clamp's tension on the picture may have a tendency to pinch or injure a non-rigid picture retained within the clamp.

Mounting systems which utilize magnet or other like picture securing means, such as disclosed in U.S. Pat. Nos. 3,345,709 to Bearman, 3,965,599 to Ebner, and 4,211,382 to Bonfils, all require specifically mounted wall backings which must be built either into or on a display surface preventing easy and quick assembly of the mounting system and can only accommodate posters whose perimeters are equal to or less than the perimeter of the wall backings. Furthermore, the utilization of corner mounting brackets (brackets which include spikes or nails for insertion into a wall, each bracket adapted to receive and support one corner of a picture, such as disclosed in U.S. Pat. No. 1,752,297 to Gillette), may provide for easy and quick mounting of various sized pictures, but cause extreme damage to display surfaces each time a bracket must be repositioned and reinserted into the display surface to accommodate pictures of various sizes.

U.S. Pat. No. 505,771 to Kohr shows a device for attachment to a music rack or the like for holding leaves or pages of music against accidental displacement while permitting them to be intentionally moved without danger of injury thereto. The device includes a lever, a fulcrum for supporting the lever, and a leaf or tongue spring for biasing the lever firmly into contact with the page. This device does not include any means to adjust the tension of the lever against the page. The tension in the spring is constant no matter what the position of the lever. Severe and firm attachment cannot be obtainable with the amount of tension obtainable from a leaf spring and is not desirable in a leaf holder.

No poster or picture mounting system has previously been available which will prevent damage to posters when removed from display surfaces and has the capability of securely and firmly mounting exhibits of various sizes. Due to the increasingly high cost of framing art exhibits, there is a great need for such an inexpensive mounting system that can easily be installed and assembled onto any planar display surface.

SUMMARY OF THE INVENTION

Accordingly, it is an object of the present invention to eliminate the deficiencies of the prior art, such as those set forth hereinabove.

It is a further object of the present invention to provide for an improved poster mounting system.

It is another object of the present invention to provide an exhibit mounting system of the non-destructible type which will prevent damage to a poster when secured on or removed from a display surface.

It is still another object of the present invention to provide an adjustable poster mounting system for accommodating the mounting of various sized posters.

It is yet another object of the present invention to provide an inexpensive poster mounting system.

It is still a further object of the present invention to provide a poster mounting system which can be easily installed and assembled onto any planar display surface.

It is another object of the present invention to provide a lever operated poster mounting system which includes means to vary the tension of the lever acting on an exhibit.

Still other objects, features and attendant advantages of the present invention will become apparent to those skilled in the art from a reading of the following detailed description of embodiments constructed in accordance therewith, taken in conjunction with the accompanying drawings.

DESCRIPTION OF PREFERRED EMBODIMENTS

Figure 1:
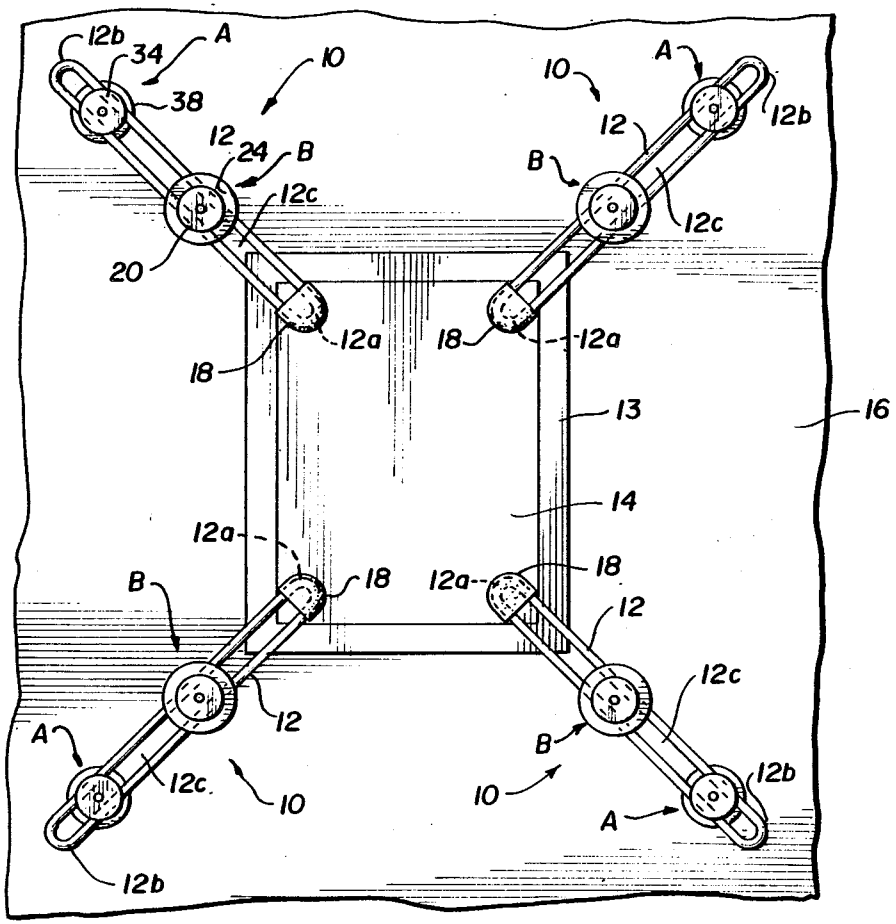
FIG. 1 is a plan view of the poster mounting system of the present invention.

The presently preferred embodiment of the present invention is illustrated in FIG. 1 of the drawings. The system comprises four (4) poster mounting assemblies 10, each mounting assembly 10 being primarily useful for non-destructively but firmly holding and securing one corner of a poster 14 against a planar display surface or wall 16.

It should be understood that the term "poster" encompasses all substantially planar creative works, such as photographs, silkscreens, frameless paintings, or other like substantially planar art exhibits. The term "poster" is only utilized for illustrative purposes in describing the use of the present invention.

Each poster mounting assembly 10 includes a lever 12 provided at one end with a poster contacting region 12*a*, an adjustable tension mechanism or adjustment means A for normally positioning lever 12 relative to a display surface, and a fulcrum B for supporting the lever 12.

Lever 12 is preferably in the form of a rigid wire loop having curved ends 12*a*, 12*b* and an elongated central slot 12*c* extending along the length of the lever's longitudinal axis. The lever 12 must have rigid properties, preferably made from metallic wire, but could also be manufactured from rigid plastics or produced from sturdy wood products, as long as the lever is substantially planar and rigid, and is equipped with an elongated central slot or aperture.

Figure 2:
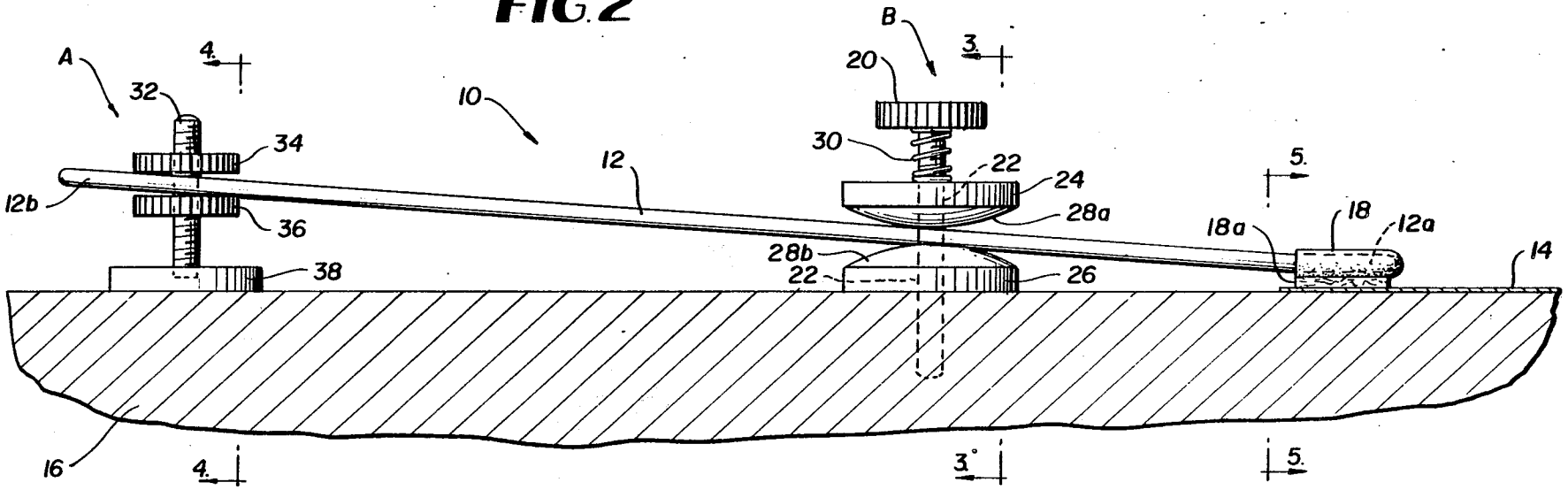
FIG. 2 is an elevational view of the poster mounting system of the present invention.
Figure 2A:
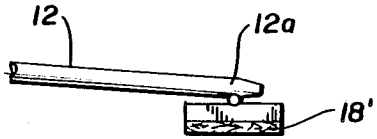
FIG. 2*a* is an elevational view of a modified embodiment of the poster contacting region of the poster mounting system of the present invention.

As mentioned above, the lever 12 is provided with a poster-contacting region 12*a*, which may be bent slightly from the longitudinal axis of lever 12, as shown in FIG. 2, for forcing an exhibit non-destructively against a display surface. The bent region 12*a* is adapted to receive a glove or sleeve-like poster pad 18 (see FIGS. 2 and 5) to protect the poster 14 from injury when the lever 12 is in the mounting mode. The pad 18 may be composed of a relatively thick foam member which will conform to the display surface regardless of the angle of the lever with respect to the surface. It should be understood that the bent region 12*a* of lever 12 acts as the poster securing means when engaged or abutted against a wall or display surface, retaining the poster therebetween.

Instead of bending the region 12*a* to be substantially parallel to the wall when in use, the lever may be completely linear and have a pivotable poster pad 18' mounted on the lever 12 which will assume a position parallel to the display surface 16 when end 12*a* is forced against display surface 16.

The lever 12 is adapted to be slidably supported within the fulcrum B and equipped with adjustable tensioning means A for normally positioning or urging the poster-contacting end 12*a* of lever 12 into contact with a poster corner.

Figure 3:
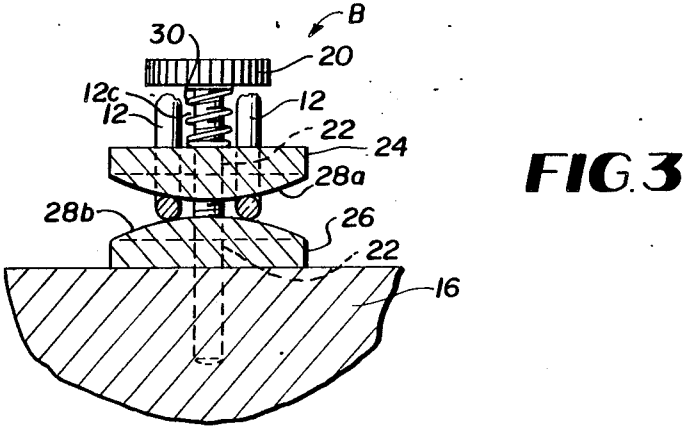
FIG. 3 is a cross-sectional view of the lever's fulcrum employed in the present invention taken along line 3—3 in FIG. 2.

Referring now to FIGS. 2 and 3, the fulcrum B, preferably made from a sturdy plastic, although any suitable material may be utilized, such as wood or metal, includes an upper member 24 and a lower member 26, both members having a central aperture 22 therethrough. Members 24,26 are preferably circular in shape as shown in FIG. 1. Upper and lower members 24,26 are maintained in an appropriately juxtaposed relationship in any manner. For example, as shown in FIGS. 2 and 3, the members 24 and 26 are freely slidable about threaded bolt or screw 20, via the members' apertures 22. A spring 30 surrounds the upper shaft region of the bolt in order to urge the upper and lower members 24,26 in an opposing joined relationship. The entire fulcrum B is secured to a display surface 16 by use of the lower shaft region of the bolt or screw 20 which can screwably penetrate the planar display surface. The fulcrum may also be maintained in the desired juxtaposition by having the apertures 22 therein threadedly engage the bolt 20. Thus, the relative position of the upper and lower members 24,26 will be maintained on the bolt 20 unless adjusted by turning, in a manner similar to that which will be discussed hereinbelow with respect to the lever tensioning means A.

Figure 6:
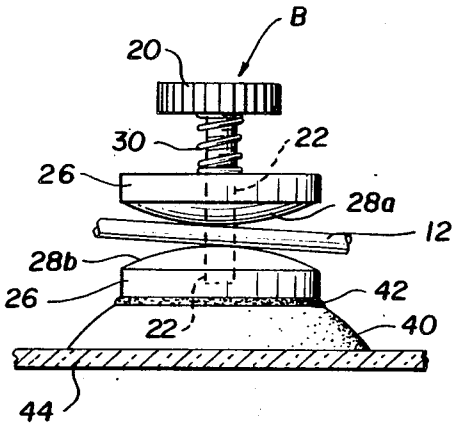
FIG. 6 is an elevational view of a fulcrum utilized in an alternate embodiment of the present invention.

In an alternate embodiment, shown in FIG. 6, the fulcrum B is secured to a display surface, such as glass window 44, by means of a suction cup device 40 adhesively (adhesive shown at 42) attached to the underside (wall side) of the fulcrum's lower member 26. In this alternate embodiment, the bolt 20 must be long enough to engage both upper and lower members 24 and 26, but short enough as not to penetrate or injure the display surface when the fulcrum is assembled and secured thereto.

The fulcrum members 24 and 26 are preferably provided with opposing convex or frustro-conically shaped inner surfaces 28*a* and 28*b*, respectively. The opposing convex surfaces 28*a*, 28*b* of the upper and lower members 24,26 facilitate the pivoting sliding and rocking movements of the lever 12 about the fulcrum. The lever 12 is maintained between fulcrum members 24 and 26 by means of bolt 20 which is received through the lever's elongated central slot 12*c*, permitting the lever 12 to pivot normally as well as parallel to the display surface about fulcrum B. Lever 12 is also capable of horizontally sliding through the fulcrum B. This feature permits the lever system to be adjusted to accommodate posters of various sizes without moving the fixed fulcrum B.

Figure 4:
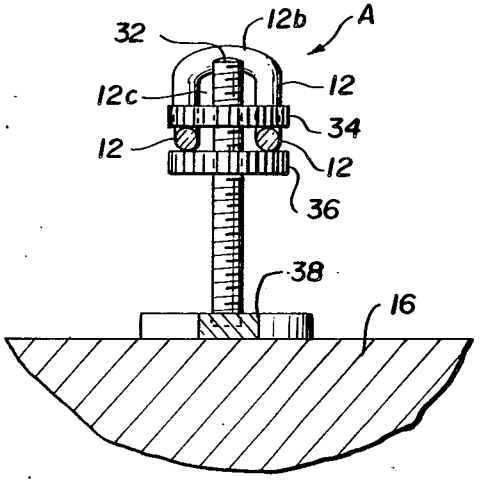
FIG. 4 is a cross-sectional view of the lever's adjustable tension mechanism employed in the present invention taken along line 4—4 in FIG. 2.

Referring now to FIG. 4, adjustable lever tensioning means A includes a non-fixed base 38 for supporting a threaded screw or bolt 32 perpendicular thereto. The bolt 32 is equipped with a pair of adjustable nuts 34,36 which can be either manually elevated or descended along the bolt's vertical length. Lever 12 is adapted to slide horizontally through the space defined between the nuts 34,36 and maintained therein by the bolt 32 which is received through the lever's central slot 12*c*. Alternatively, the tensioning means could be attached to the lever at a fixed position thereon. When the nuts 34,36 are adjusted to an elevated position, as shown in FIGS. 2 and 4, the fulcrum B causes lever end 12*a* to abut or force a poster 14 non-destrictively against an adjacent display surface 16. The height of the lever end 12*b*, as set by the nuts 34,36 determine the relative amount of force exerted on the poster 14 by lever end 12. This can be considerably greater than that which would be possible by means of a leaf spring. The tension on the lever 12 also holds bore 38 in position on the display surface.

When the tension on the lever is released by adjusting tne nuts 34,36 to lower lever end 12*b*, the lever end 12*a* is free to rise and release the poster 14. In this mode, the lever 12 is free to side longitudinally with respect to fulcrum B and rotate about bolt 20 of fulcrum B so that the lever end 12*a* can be placed in a desired spot to hold a poster of a different size or shape. When in position, the lever 12 can again be tensioned by adjusting the nuts 34,36.

Figure 5:
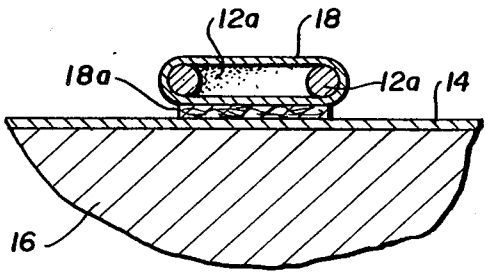
FIG. 5 is a cross-sectional view of the lever's mounting pad employed in the present invention taken along line 5—5 in FIG. 2.

As discussed above, the lever end region 12*a* is adapted to receive a removable glove or sleeve-like poster pad 18 (see FIG. 5). The poster pad 18, made from any suitable fabric material, such as canvas or cotton fabric, includes an adhesively secured felt poster protecting region 18*a* which protects the poster 14 from injury or pinch when the lever end 12*a* abuts the poster against an adjacent display surface 16.

It should be understood that the sleeve-like poster pad 18 can be of various colors to blend in with the background of a poster so as not to disrupt a picture's color scheme.

Furthermore, the poster pad 18 could include a magnet or magnetized surface (not shown) when utilized on a metallic display surface.

It should also be understood that the poster mounting assemblies 10 could also include a mat background 13 (see FIG. 1) to facilitate a bordered or framed region for an exhibiting poster.

It should be further understood that the poster mounting assembly 10 can be either permanently installed onto a display surface or removable therefrom. Additionally, each poster mounting assembly 10 includes components of quick and easy assembly and disassembly, the components being produced inexpensively.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An adjustable mounting system for the non-destructive mounting of any of various sized displays onto a display surface, comprising:

a lever having a longitudinal axis, a first end and a second end;

fulcrum means for providing two fulcrum points, a lower fulcrum point acting on the side of said lever facing the display surface when in use at a selected point on the longitudinal axis of the lever, and an upper fulcrum point acting on the opposite side of said lever and facing said lower fulcrum point;

securing means for securing said fulcrum means onto the display surface; and tensioning means, disposed on said lever on the opposite side of said fulcrum means from said first end of said lever, for adjustably setting the position of said lever with respect to the display surface when said fulcrum means is secured to the display surface.

2. An adjustable mounting system in accordance with claim 1, wherein each of said fulcrum points has a convex surface facing the opposite fulcrum point.

3. An adjustable mounting system in accordance with claim 2, wherein said securing means comprises a bolt passing through the center of said upper and lower fulcrum points and extending through said lower fulcrum point for engagement with the display surface.

4. An adjustable mounting system in accordance with claim 1, wherein said lever is longitudinally adjustable with respect to said fulcrum points.

5. An adjustable mounting system in accordance with claim 3, wherein said lever has a longitudinal slot, and wherein said bolt of said securing means passes through said slot whereby said lever is longitudinally and rotatably adjustable with respect to said fulcrum means.

6. An adjustable mounting system in accordance with claim 1, wherein said tensioning means comprises a base adapted to rest against the display surface when in use, a threaded bolt extending from said base and at least one nut threadedly engaging said bolt, whereby said nut is adapted to engage said lever when in use.

7. An adjustable mounting system in accordance with claim 6, wherein said lever has a longitudinal slot and said bolt of said tensioning means passes through said slot.

8. An adjustable mounting system in accordance with claim 7, wherein said tensioning means further includes a second nut threadedly engaging said bolt and disposed on the opposite side of said lever from said first nut.

9. An adjustable mounting system in accordance with claim 1, further including a display engaging surface connected to said first end of said lever for non-destructively engaging the display when in use.

10. An adjustable mounting system in accordance with claim 3, wherein said fulcrum means further includes spring means for urging said upper fulcrum point toward said lower fulcrum point.

11. An adjustable mounting system in accordance with claim 3, wherein said bolt of said securing means is threaded and said upper and lower fulcrum point threadedly engage said bolt.

12. An adjustable mounting system in accordance with claim 1, wherein said securing means is a suction cup device attached to said fulcrum means.

13. A adjustable mounting system for the non-destructive mounting of any of various sized displays onto a display surface, comprising:

a lever having a longitudinal axis, a first end and a second end;

fulcrum means for providing a fulcrum point on at least one side of said lever at a selected point on the longitudinal axis of the layer;

securing means for securing said fulcrum means onto the display surface; and tensioning means, disposed on said lever on the opposite side of said fulcrum means from said first end of said lever, for adjustable setting the position of said lever with respect to the display surface then said fulcrum means is secured to the display surface, wherein said fulcrum point acts on the opposite side of said lever from the display surface when said fulcrum means is secured to the display surface, and wherein said lever is longitudinally adjustable with respect to said fulcrum point.

14. An adjustable mounting system in accordance with claim 13, wherein sid tensioning means comprises a base adapted to rest against the display surface when in use, a threaded bolt extending from said base and at least one nut threadedly engaging said bolt, whereby said nut is adapted to engage said lever when in use.

15. An adjustable mounting system in accordance with claim 14, wherein said lever has a longitudinal slot and said bolt of said tensioning means passes through said slot.

16. An adjustable mounting system in accordance with claim 15, wherein said tensioning means further includes a second nut threadedly engaging said bolt and disposed on the opposite side of lever from said first nut.

17. An adjustable mounting system for the non-destructive mounting of any of various size displays onto a display surface, comprising:

a lever having a longitudinal axis, a first end and a second end;

fulcrum means for providing a fulcrum point on at least one side of said lever at a selected point on the longitudinal axis of the lever;

securing means for securing said fulcrum means onto the display surface; and tensioning means, disposed on said lever on the opposite side of said fulcrum means from said first end of said lever, for adjustable setting the position of said lever with respect to the display surface when said fulcrum means is secured to the display surface, said tensioning means comprising a base adapted to rest against the display when in use, a threaded bolt extending from said base and at least one nut threadedly engaging said bolt, whereby said nut is adapted to engage said lever when in use, wherein sid fulcrum point acts on the opposite side of said lever from the display surface when said fulcrum means is secured to the display surface.

18. An adjustable mounting system in accordance with claim 17, wherein said lever has a longitudinal slot and said bolt of said tensioning means passes through said slot.

19. An adjustable mounting system in accordance with claim 18, wherein said tensioning means further includes a second nut thrededly engaging said bolt and disposed on the opposite side of said lever from said first nut.

* * * * *